United States Patent [19]

Tajima

[11] Patent Number: 4,637,669

[45] Date of Patent: Jan. 20, 1987

[54] CONNECTOR SOCKET

[75] Inventor: Kyousuke Tajima, Gunma, Japan

[73] Assignee: Hosiden Electronics Co., Ltd., Osaka, Japan

[21] Appl. No.: 791,869

[22] Filed: Oct. 28, 1985

[30] Foreign Application Priority Data

Jun. 7, 1985 [JP] Japan ..... 60-86148

[51] Int. Cl.[4] ..... H01R 4/66

[52] U.S. Cl. ..... 339/14 R; 200/51.07; 339/17 LC

[58] Field of Search ..... 339/14 R, 143 R, 17 LC, 339/182 R, 183; 200/51.07

[56] References Cited

U.S. PATENT DOCUMENTS 4,486,059 12/1984 Deyoung ..... 339/14 R

FOREIGN PATENT DOCUMENTS 0118168 9/1984 European Pat. Off. ..... 339/143 R
1515850 1/1970 Fed. Rep. of Germany ... 339/17 LC
2733634 2/1979 Fed. Rep. of Germany .... 339/14 R
3308492 9/1984 Fed. Rep. of Germany ... 339/143 R

*Primary Examiner*—Eugene F. Desmond
*Attorney, Agent, or Firm*—Pollock, Vande Sande and Priddy

[57] ABSTRACT

A connector socket, similar to a so-called DIN type socket, has a terminal board attached to a side surface of the connector socket insulating body, and contacts are bent at a right angle to extend from the rear end surface of the insulating body and are passed through the terminal board as the terminals. An annular contact is inserted into an annular recessed groove formed in a front surface of the insulating body and earth terminals are formed to extend from the rear end of the annular contact and project out behind the insulating body. A U-shaped shield cover is mounted to cover the side surfaces of the insulating body. The shield cover is coupled and fixed to the earth terminals, and shield terminals are formed integrally with the shield cover at both end portions of the U-shape to extend beyond the terminal board.

14 Claims, 15 Drawing Figures

CONNECTOR SOCKET

FIELD OF THE INVENTION

The present invention relates to a connector socket which is mounted, for example, to a personal computer in order to connect personal computers.

BACKGROUND OF THE INVENTION

The applicant of the present patent application has proposed, in the Japanese Utility Model Application No. 57-172593, Connector Socket, a connector socket having the excellent characteristics that it exhibits a strong engaging force to the plug although small in size and does not easily release the plug, the plug inserting position can be found easily, and on the occasion of inserting the plug the male contacts of the plug are prevented from being placed in contact with female contacts in the incorrect positions.

The characteristic structure of the connector socket proposed previously and the effects obtained from that structure are outlined hereinafter in reference to FIGS. 1 to 3.

The connector socket in question has a structure in which an annular recessed groove 2 is formed, as shown in FIG. 1, at one end surface (front surface) of an insulation body 1 to/from which the plug is inserted or removed, and a cylindrical annular contact 3 as shown in FIG. 2 is engaged with the annular recessed groove 2.

A plurality of female contact accommodating holes 5 are formed in a cylindrical portion of the insulation body 1 surrounded by the annular recessed groove 2. In this example, five female contact accommodating holes 5 are formed. The structure explained up to this step is similar to that of a connector socket which is generally called the DIN type connector.

The first feature of this connector socket is that in spite of being small in size it ensures a strong engaging force to a plug owing to a structure in which orthogonally crossing diameters $L_1$ and $L_2$ of the annular contact 3 are selected to be $L_1 > L_2$ as shown in FIG. 2 to form a cylindrical ellipse.

Where the annular contact 3 is formed as such a cylindrical ellipse, a sufficiently strong engaging force to a cylindrical metal cover 6 of plug 50 can be obtained when the plug 50 shown in FIG. 3 is inserted into the connector socket. Accordingly, a strong engaging force can be obtained even when the engaging area of the cylindrical metal cover 6 of the plug 50 is narrowed due to reduction in size of the plug. As a result, even if a pulling force is applied to a cable 51 connected to the plug 50, the plug 50 will not easily fall out of the socket.

It is the second feature of the connector socket shown in FIG. 1 that auxiliary recessed grooves 8A, 8B are formed, in addition to a main recessed groove 7 for positioning, in the circumference of a cylindrical column portion 4 surrounded by the annular recessed groove 2 as shown in FIG. 1.

Corresponding respectively to the main recessed groove 7 for positioning and auxiliary recessed grooves 8A and 8B, a main protrusion 9 for positioning and auxiliary protrusions 11A, 11B are formed to the internal surface of the cylindrical metal cover 6 of the plug 50 as shown in FIG. 3. The inserting positions are prevented from being confused by making the main protrusion 9 different in size from the auxiliary protrusions 11A, 11B. Since three recessed grooves 7, 8A and 8B and three protrusions 9, 11A and 11B are provided, if the plug and socket are not in a correct engaging position with respect to each other when an attempt is made to insert the plug 50 into the socket, the three protrusions 9, 11A and 11B abut the circular edge of the cylindrical column portion 4 surrounded by the annular recessed groove 2, thereby positioning the axial center of plug 50 in agreement with the axial center of socket. Therefore, while such condition is maintained, the plug 50 can easily be rotated about the axial center of socket to find the correct engaging position.

It is the third feature of the connector socket of FIG. 1 that a square hole 12 is formed in the cylindrical column portion 4 surrounded by the annular recessed groove 2 as shown in FIG. 1. This square hole 12 is engaged with an insulated square column 13 (in FIG. 3) provided in the plug 50 and this engagement also defines the correct engaging position between the plug and socket. This insulated square column 13 is formed a little longer than contact pins 14 of the plug 50. Owing to this structure, it is only when the insulated square column 13 enters the square hole 12 the socket that insertion of the contact pins 14 of the plug 50 to the female contact accommodation holes 5 can be allowed. As a result, there is no chance for the contact pins 14 of plug 50 to enter wrong female contact accommodating holes 5 of the socket.

As explained above, the connector socket proposed previously results in the effects that a strong engaging force to the plug can be ensured even with a smallsized socket, a plug inserting position can be found easily, and incorrect connection will never occur.

However, a small-sized connector socket of the type described above has a structure which cannot be mounted directly on a printed circuit substrate because terminals for the female contacts are led out from the rear surface opposite to the plug inserting and removing surface.

Moreover, since the annular contact 3 does not perfectly cover the female contact up to the rear end side, sufficient shielding function by the annular contact 3 cannot be obtained. Therefore, if this connector socket is used for connection with a personal computer, for example, various disadvantages may occur, namely, external noise can enter via said connector socket and destroy data in the computer, and the signals sent or received through this connector socket may be sent therethrough to the outside.

SUMMARY OF THE INVENTION

It is an object of the present invention to provide a connector socket which can directly be mounted on a printed circuit substrate in parallel to the plug inserting and removing direction and does not allow entrance of external noise and leakage of signals to the outside.

According to the present invention, a terminal board is attached to a side surface of an insulating body, a plurality of contact accommodating holes are formed in a cylindrical column portion of the insulating body surrounded by the annular recessed groove, female contacts accommodated in these female contact accommodating holes are bent and extended at a right angle at the rear surface of the insulating body, and such extended portions are positioned and inserted into the corresponding slots in the terminal board to project out therefrom as the terminals. An annular contact is mounted concentrically in the annular recessed groove and an earth terminal is formed integrally with the annular contact to protrude from the rear surface of the insulating body. The side surfaces of the insulating body, except for the side of the terminal board, is covered with a shield cover, which is mechanically and electrically coupled to the earth terminal, and a pair of earth terminals formed integrally with the shield cover are protruded on both sides of the terminal board in the protruding direction of the female contact terminals.

The terminals protruded from this terminal board can directly be mounted on the printed circuit board and the contacts are shielded from the outside by the shield cover to reduce the influence of external noise.

DETAILED DESCRIPTION OF THE INVENTION

Figure 1:
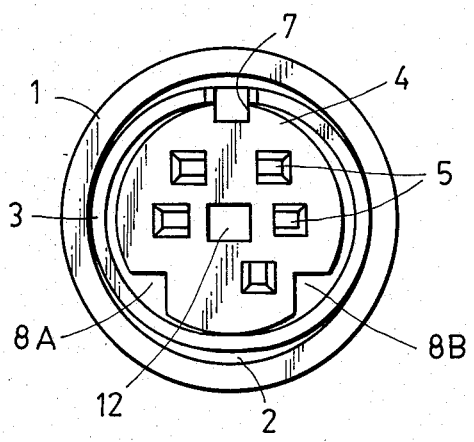
FIG. 1 PRIOR ART
FIG. 1 is a front elevation of a connector socket of the prior art.
Figure 2:
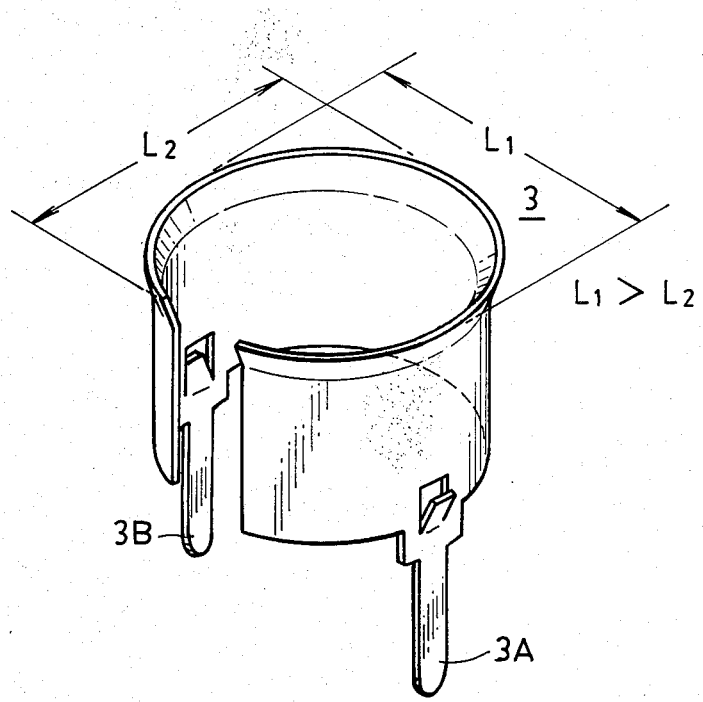
FIG. 2 PRIOR ART
FIG. 2 is a perspective view illustrating an annular contact 3 in FIG. 1.
Figure 4:
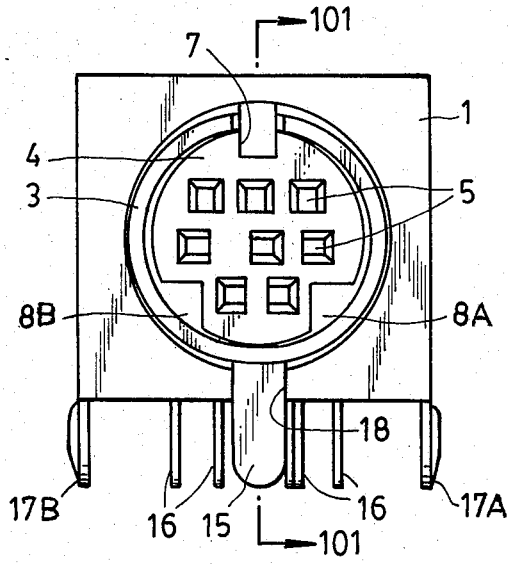
FIG. 4 is a front elevation illustrating an example of the connector socket of the present invention.
Figure 7:
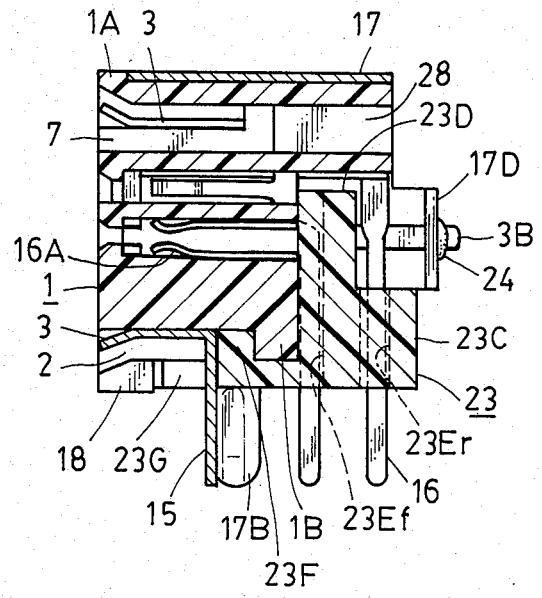
FIG. 7 is a sectional view along the line 101—101 of FIG. 4.
Figure 8:
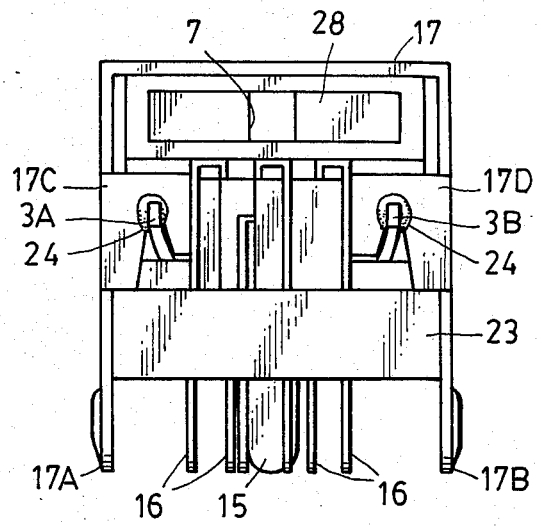
FIG. 8 is a rear side view of FIG. 4.
Figure 9:
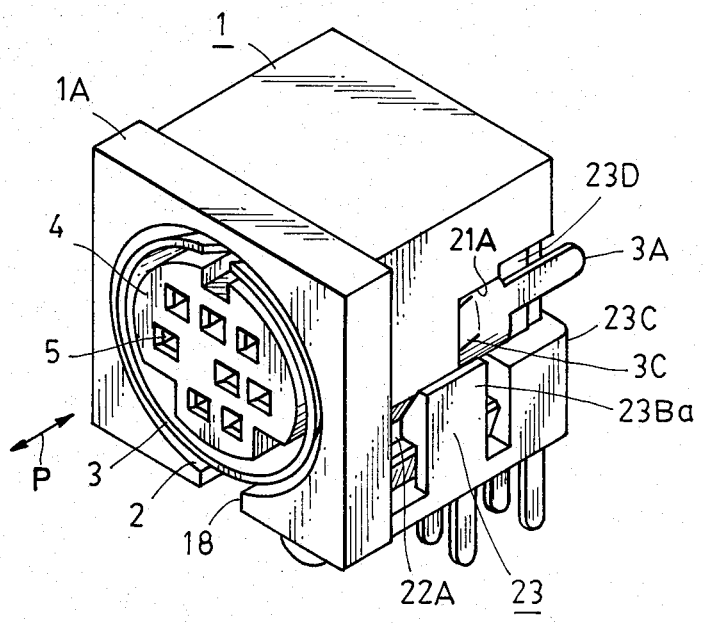
FIG. 9 is a perspective view illustrating the state in which the shield cover is removed from the connector socket of FIG. 4.

A preferred embodiment of the present invention will now be explained with reference to FIG. 4 to FIG. 14. As shown in FIG. 4 and FIG. 9, the connector socket of the present invention has the structural features, when viewed from the front side thereof, that the external side of annular recessed groove 2 of an insulating body 1 is square, and an earth terminal 15 and female contact terminals 16 protrude from one side surface of the insulating body 1. Earth terminals 17A, 17B are extended integrally from a shield cover 17 and also protrude from the side where the earth terminal 15 of the insulating body 1 protrudes. In this example, eight female contact accommodating holes 5 are formed in a cylindrical column portion 4. When eight female contact accommodating holes 5 are provided, the square hole 12 explained with respect to FIG. 1 is not provided.

Figure 10:
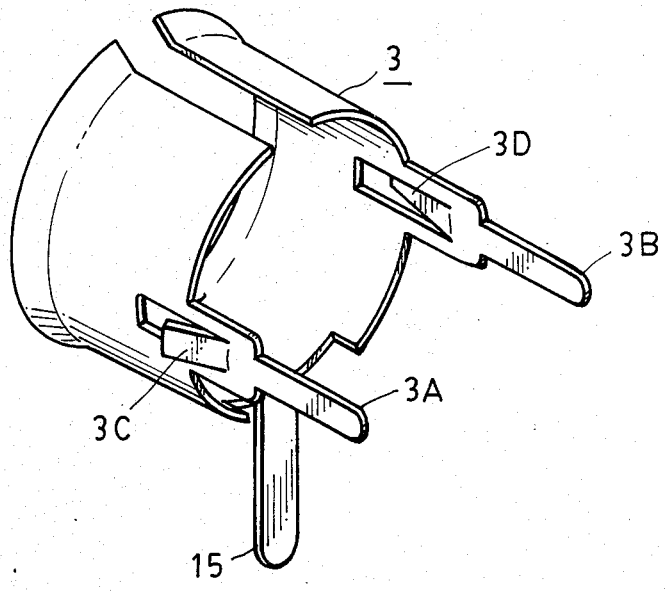
FIG. 10 is a perspective view illustrating the annular contact of FIG. 4.
Figure 11:
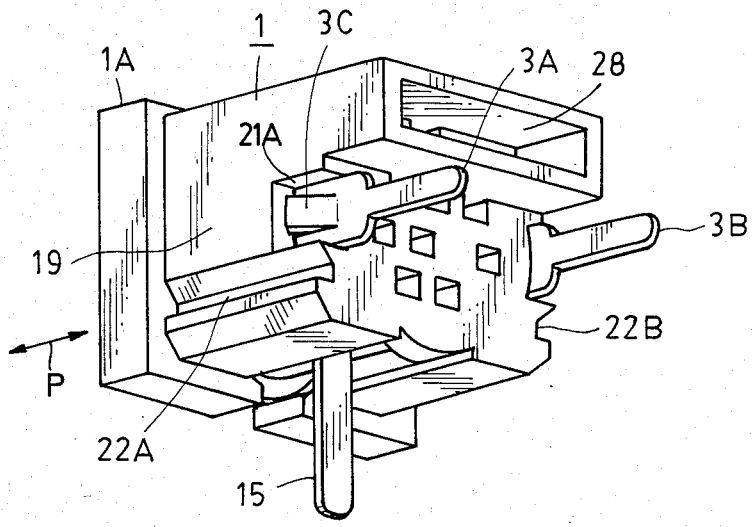
FIG. 11 is a rear perspective view of the connector socket of FIG. 4 where the shield cover and a terminal board are removed.

As shown in FIG. 10, an annular contact 3 is provided with the third earth terminal 15 in a direction orthogonally crossing the axial center, in addition to a pair of earth terminals 3A, 3B that protrude from the rear end in parallel to the axial center of the annular contact 3. As shown in FIG. 7 and FIG. 9 the annular contact 3 is inserted into an annular recessed groove 2 so that the third earth terminal 15 is disposed in a groove 18 formed in the front end face of the insulating body 1. As shown in FIG. 9 and FIG. 11, rear portions on both sides of external circumferential wall 19 of the annular recessed groove 2 are cut out to form open windows 21A, 21B (21B is not seen) communicating with the annular recessed groove 2. Tongue pieces 3C, 3D (FIGS. 9 and 10) formed integrally with the annular contact 3 are engaged with the side edges of the open windows 21A, 21B, and thereby fix the annular contact 3 within the annular recessed groove 2.

As shown in FIG. 9 and FIG. 11, grooves 22A, 22B are respectively formed in the insulating body 1 below the open windows 21A, 21B in parallel to the plug inserting and removing direction P and a terminal board 23 of insulation material can be mounted to the insulating body 1 utilizing these grooves 22A, 22B.

Figure 12:
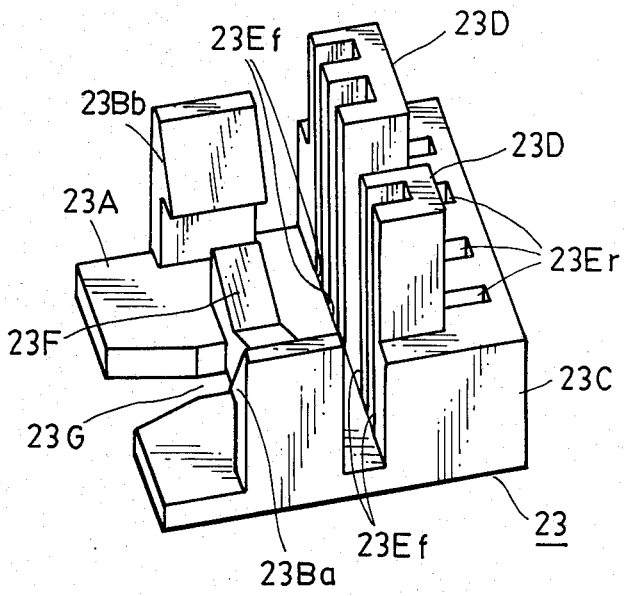
FIG. 12 is a perspective view of the terminal board.

As shown in FIG. 9 and FIG. 12, the terminal board 23 comprises a bottom plate 23A, a pair of pawls 23Ba, 23Bb which opposingly protrude form both side edges of the bottom plate 23A, and a terminal support 23C formed integrally with the bottom plate at one side thereof to support the terminals 16, and the terminal board 23 is mounted to the insulating body 1 of FIG. 11 as shown in FIG. 9 by engaging the pawls 23Ba, 23Bb and the grooves 22A, 22B formed in the insulating body 1. Guide pillars 23D which guide the terminals are protruded from the terminal support 23C.

Figure 13:
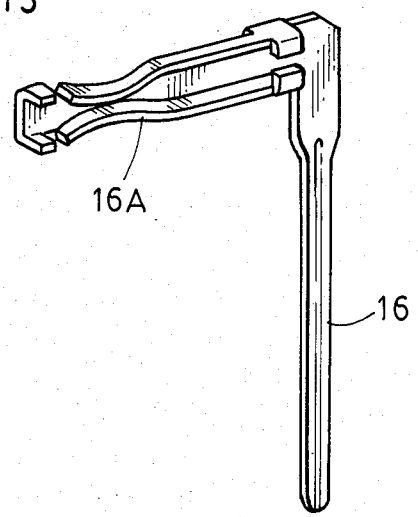
FIG. 13 is a perspective view of contacts.

Before attaching the terminal board 23, a female contact 16A shown in FIG. 13 is inserted into each female contact accommodating hole 5 in the insulating body 1, and the terminals 16 integrally extending from the rear ends of the female contacts 16A at a right angle thereto are arranged on the side of the terminal board 23. In this state, the terminals 16 are inserted into corresponding slots among a plurality of slots 23Ef, 23Er formed in the terminal support 23C of the terminal board 23A, and the terminal board 23 is pushed upwardly against the insulating body 1 to resiliently snap the pawls 23Ba, 23Bb into the grooves 22A, 22B as seen in FIG. 9. Thus, the terminals 16 are fixed to the terminal board 23. A cut-away 23G formed at the center of front edge of the terminal board 23 allows to pass therethrough the earth terminal 15 formed integrally with the annular contact 3. Owing to the cut-away 23G formed in the front marginal side of the terminal board 23, it is possible to prevent the flux, used at the time of soldering to the printed circuit board, from climbing along the earth terminal 15. More particularly, if a narrow slot were formed in the plate 23 in place of the cut-away part 23G and the earth terminal 15 inserted thereinto, a narrow gap may be formed between the earth terminal 15 and the inner surface of the slot, allowing the flux to climb through the narrow gap as a result of capillary action so as to extend along the circumferential surface of the annular contact 3, causing corrosion of the annular contact 3. Therefore, in the case of this embodiment, the earth terminal 15 is passed through the cut-away part 23G so as not to produce such capillary action. However, if required, the earth terminal 15 may be passed through such slot in the terminal board 23, rather than through the cut-away part.

As shown in FIG. 12, a positioning protrusion 23F is formed integrally with the terminal board 23 on the plate 23A thereof at the center of an area in front of the terminal support 23C. Also, as shown in FIG. 7, an engaging part 1B is formed integrally with the insulating body 1 to engage between the positioning protrusion 23F and terminal support 23C. The engagement of part 1B, the terminal support 23C and the positioning protrusion 23F determines the positioning of the terminal board 23 with respect to the insulating body 1 in forward and backward directions. Moreover, in this embodiment, the terminal support 23C is abutted to the rear surface of the insulating body 1.

Figure 6:
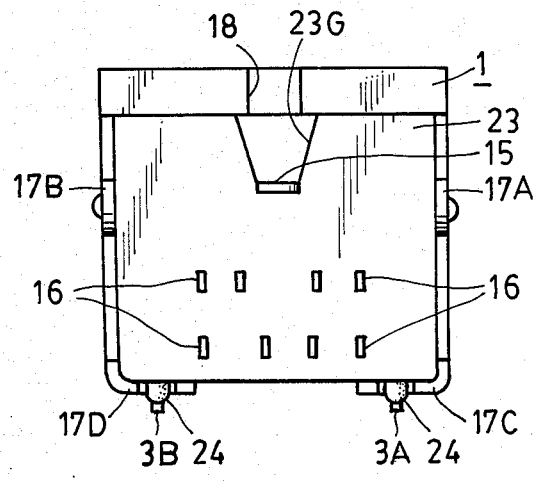
FIG. 6 is a bottom view of FIG. 4.

As shown in FIG. 6 and FIG. 12, the terminal positioning slots 23Ef, 23Er are arranged in two rows: the rear slots 23Er are formed behind the guide pillars 23D in contact therewith and the front slots 23Ef are formed in the front surfaces of the guide pillars 23D to extend therealong. The guide pillars 23D separate a plurality of terminals 16 from one another and work as guides when being inserted between the front and rear rows of the terminals 16.

As is apparent from above explanation, the female contact terminals 16 are led out from one side surface of the socket, and the terminals 16 can directly be connected to the printed circuit board (not shown) by mounting the socket thereon with the side surface being opposed to the printed circuit board.

Figure 14:
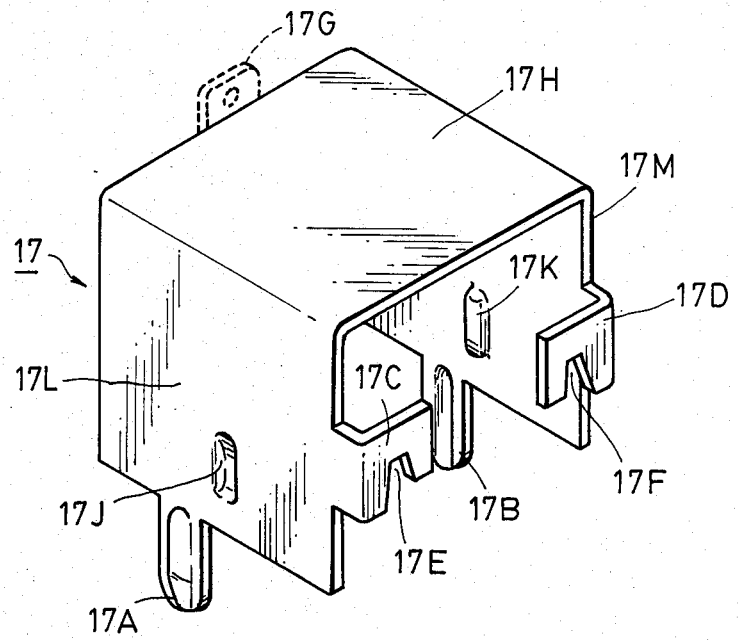
FIG. 14 is a perspective view of the shield cover.

The present invention is also characterized in that the insulating body 1 is covered with the shield cover 17. The shield cover 17, for example, as shown in FIG. 14, has a U-shape formed by bending a press-cut conductive plate, and earth terminals 17A, 17B are provided to protrude from the ends of leg portions 17L, 17M of the U-shape. A pair of connecting pieces 17C, 17D are formed to extend from marginal rear sides of the two leg portions 17L, 17M of the shield cover 17 and are bent toward each other. These connecting pieces 17C, 17D have cut-away portions 17E, 17F opened downward. Earth terminals 3A, 3B extended from the annular contact 3 are passed through the cut-away portions 17E, 17F, where the connecting pieces 17C, 17D and terminals 3A, 3B are respectively connected mechanically and electrically by solder 24 as shown in FIGS. 6, 7 and 8 and thereby the shield cover 17 can be fixed to the insulating body 1.

Figure 5:
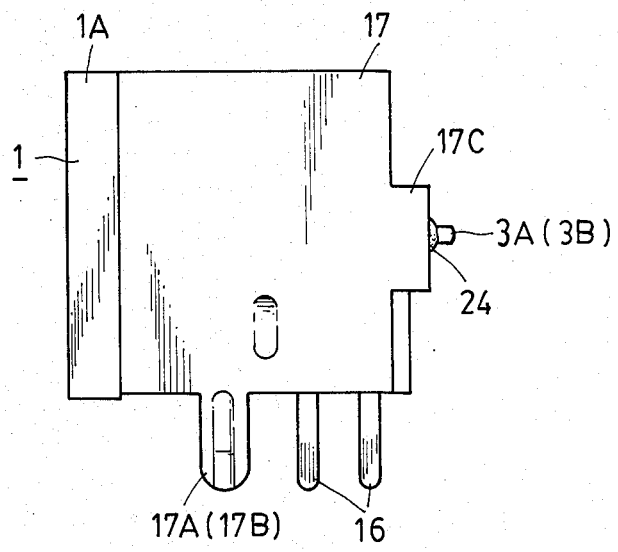
FIG. 5 is a right side elevation of FIG. 4.

The leg portions 17L, 17M each form an angle a little smaller than a right angle with respect to a central connecting portion 17H of the shield cover 17. When the insulating body 1 is covered with the shield cover 17, the leg portions 17L, 17M elastically engage the two sides of the terminal plate 23, thereby to hold the shield cover 17 on the insulating body 1. A flange 1A is formed, as shown in FIG. 9, integrally with the insulating body 1 to extend in flush relation with the front surface of the insulating body 1, and the shield cover 17 is mounted on the insulating body 1 adjacent the rear surface of the flange 1A as shown in FIG. 5. In this embodiment, moreover, as shown in FIG. 14, positioning inward protrusions 17J, 17K are formed on inner surfaces of the leg portions 17L, 17M of the shield cover so as to be engaged between the pawls 23Ba, 23Bb and the terminal support 23C, thereby positioning the shield cover 17 in forward and backward directions with respect to the insulating body 1.

As explained above, the connector socket of the present invention allows direct mounting to the printed circuit board. Moreover, the connector socket employs the structure in which the insulating body 1 is covered with the shield cover 17 over substantially the entire extent from the front end to the rear end thereof. Thus, it is possible to reduce external noises to be induced to the female contacts 16A and it is also possible to lower the leakage of signals flowing through the female contacts 16A. Particularly, since connection to the ground circuit of the printed circuit board is made through the three earth terminals 15, 3A and 3B of the annular contact 3 directly and via the earth terminals 17A, 17B of the shield cover 17, the electric resistances from the annular contact 3 and the shield cover 17 up to the ground become almost equal and differences in noise potential at respective points on the annular contact 3 and the shield cover 17 are reduced, resulting in improvement of the shielding effect. Therefore, in case the connector socket of the present invention is used for connection between computers, it is possible to reduce destruction of data due to entrance of external noises and to ensure high reliability in sending and receiving of signals.

The connector socket of the present invention can be fixedly supported to the printed circuit board by the earth terminals 17A, 17B protruded from the shield cover 17 in addition to the earth terminal 15 protruded from the annular contact 3. Therefore, the supporting force for the socket is strengthened and the connector socket will not come off from the printed circuit board even when a little excessive force is applied to the socket for insertion or removal of a plug. In other words, since a conductive plate thicker than that used for the terminals 16 can be used for the shield cover 17, a strong supporting force can be ensured by connecting the earth terminals 17A, 17B of the shield cover 17 to the earth circuit of the printed circuit board.

As shown by a broken line in FIG. 14, a mounting lug 17G may be provided at the marginal front side of the connecting portion 17H of the shield cover 17 so that the connector socket can be mounted directly to a chassis, etc. In this case, the supporting force for the connector socket can further be increased and the shielding effect can also be as much improved.

Figure 3:
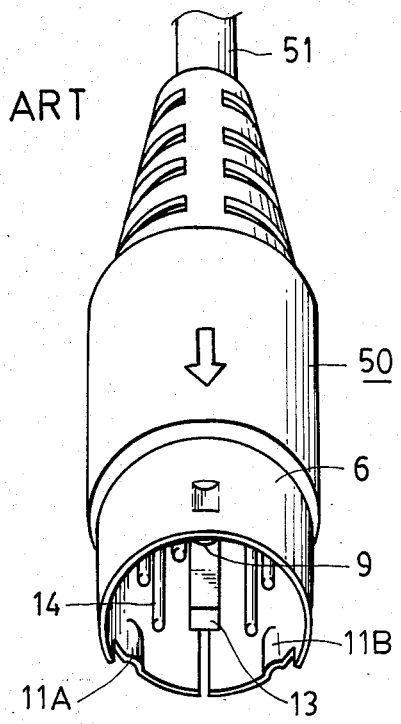
FIG. 3 PRIOR ART
FIG. 3 is a perspective view illustrating a connector plug coupled to the connector socket.
Figure 15:
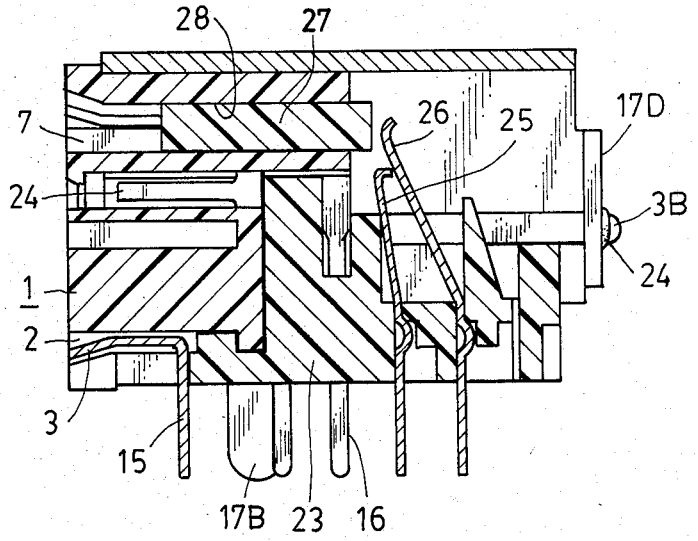
FIG. 15 is a sectional view corresponding to FIG. 7 illustrating a connector socket provided with a switch to which the present invention is applied.

Moreover, as shown in FIG. 15, the present invention can be applied to a connector socket that is provided with a switch. In FIG. 15, a switch is formed with contact pieces 25, 26 supported by the plate 23A of the terminal board 23, and a rectangular plate-like actuator made of an insulation material is provided inside a retangular hole 28 which is open toward the rear end of the insulating body 1 so that the actuator 27 is slidably movable to project out from the hole 28 (see also FIGS. 7, 8 and 11). As the metal cover 6 of the plug 50 such as shown in FIG. 3 is inserted into the annular recessed groove 2, the protrusion 9 of the cover 6 pushes the actuator 27 backward to displace the upper end of contact piece 26 apart from a contact piece 25, and thereby the switch is set to OFF state.

A connector socket with such a switch, and which ensures high reliability for signals, can be obtained by covering the connector socket of the structure as mentioned above with the shield cover 17.

What is claimed is:

1. A connector socket comprising:

an insulating body having an annular recessed groove formed therein to extend from a front surface toward a rear surface of said body, a plurality of female contact accommodating holes formed in a cylindrical column portion surrounded by said annular recessed groove, to extend from the front surface toward the rear surface, and a main positioning recessed groove and an auxiliary positioning recessed groove formed in a circumferential surface of said cylindrical column portion;

a terminal board made of an insulation material attached to one side surface of said insulating body and having a plurality of guide slots for terminal positioning formed to extend in a direction perpendicular to the extending direction of said female contact accommodating holes;

a plurality of female contacts respectively accommodated in said female contact accommodating holes and having bent portions extending at right angles to form terminals behind the rear surface of said insulating body, said terminals being inserted, for positioning, into corresponding said guide slots of said terminal board;

an annular contact concentrically inserted into said annular recessed groove of said insulating body and having first earth terminal means protruded from the rear surface of said insulating body; and a shield cover electrically and mechanically connected to said first earth terminal means, for covering the side surfaces of said insulating body except for the side of said terminal board, said shield cover having second earth terminal means extending on both sides of said terminal board beyond the surface of said terminal board.

2. A connector socket according to claim 1 wherein a pair of open windows are formed in opposed side surfaces of said insulating body to reach said annular recessed groove for engagement with tongue pieces respectively formed by cutting-and-raising part of said annular contact.

3. A connector socket according to claim 1 wherein a third earth terminal means is formed integrally with said annular contact to extend at a right angle to an axis of said annular contact from a rear marginal edge thereof, said third earth terminal being fitted in a cut-away groove formed in the front surface of said insulating body to extend from said annular recessed groove to the side of said terminal board.

4. A connector socket according to claim 3 wherein a cut-away part is formed in the front marginal edge of said terminal board in alignment with said cut-away groove and said third earth terminal means is projected out through said cut-away part.

5. A connector socket according to claim 3 wherein connecting means is formed integrally with said shield cover to project from the rear marginal edge thereof and connected, mechanically and electrically with said first earth terminal means of said annular contact.

6. A connector socket according to claim 5 wherein said first earth terminal means comprises a pair of terminals formed on the rear marginal edge of said annular contact at radially opposite positions, and said connecting means comprises a pair of connecting pieces formed on the rear marginal edges of the opposing sides of said shield cover and having U-shaped cut-away portions through which said pair of terminals are extended and soldered thereat to said pair of connecting pieces.

7. A connector socket of claim 5 wherein said shield cover is formed in a U-shape by bending a metal plate.

8. A connector socket according to claim 1 wherein said terminal board comprises a rear portion formed integrally therewith for holding a plurality of contact pieces in tandem constituting switch means, and there is provided in said main positioning recessed groove an actuator slidably movable forward and backward so as to actuate said switch means.

9. A connector socket of claim 1 wherein said terminal plate comprises a base plate opposing to said insulating body and a pair of pawls protruded opposingly from both side edges of said base plate, grooves are respectively formed in both side surfaces of said insulating body, and said terminal board is attached to said insulating body to engage said pawls with said grooves.

10. A connector socket according to claim 9 wherein said terminal plate comprises terminal support means formed integrally with said base plate to rise upright at the rear part thereof, and said terminal support means has said plurality of guide slots formed therein for positioning terminals.

11. A connector socket according to claim 10 wherein said terminal plate comprises a positioning protrusion integrally formed on said base plate in front of said terminal support means, and said insulating body comrpises an engaging part formed integrally therewith to protrude downwardly from the rear end of said insulating body, said engaging part being engaged between said terminal support means and said positioning protrusion.

12. A connector socket according to claim 10 wherein said shield cover comprises positioning protrusions formed on inner side surfaces thereof opposing each other, for engagement between said terminal support means and said pawls.

13. A connector socket according to claim 10 wherein said terminal support means comprises rear wall means and guide pillar means formed on a front side of said rear wall means integrally therewith to project above a top face of said rear wall means, and said guide slots are formed separately from one another in both said rear wall means and said guide pillar means to extend therethrough.

14. A connector socket according to claim 13 wherein the said guide slots which are formed in said guide pillar means are open along a front surface of said guide pillar means, and the said guide slots which are formed in said rear wall means extend immediately behind a rear surface of said guide pillar means.

* * * * *